US009554609B2

(12) United States Patent
Greber et al.

(10) Patent No.: US 9,554,609 B2
(45) Date of Patent: Jan. 31, 2017

(54) BELT CLOSURE AND CHIN STRAP OF A PROTECTIVE HELMET EQUIPPED THEREWITH

(71) Applicant: PFANNER SCHUTZBEKLEIDUNG GMBH, Hohenems (AT)

(72) Inventors: Martin Greber, Götzis (AT); Anton Pfanner, Hohenems (AT)

(73) Assignee: PFANNER SCHUTZBEKLEIDUNG GMBH, Hohenems (AT)

( * ) Notice: Subject to any disclaimer, the term of this patent is extended or adjusted under 35 U.S.C. 154(b) by 193 days.

(21) Appl. No.: 14/352,819

(22) PCT Filed: Oct. 30, 2012

(86) PCT No.: PCT/IB2012/002673
§ 371 (c)(1),
(2) Date: Apr. 18, 2014

(87) PCT Pub. No.: WO2013/064899
PCT Pub. Date: May 10, 2013

(65) Prior Publication Data

US 2014/0250572 A1 Sep. 11, 2014

(30) Foreign Application Priority Data

Oct. 31, 2011 (DE) ..... 10 2011 054 945

(51) Int. Cl.
*A42B 3/08* (2006.01)
*A44B 11/00* (2006.01)
*A44B 11/26* (2006.01)

(52) U.S. Cl.
CPC ..... *A42B 3/08* (2013.01); *A44B 11/006* (2013.01); *A44B 11/263* (2013.01); *Y10T 24/45241* (2015.01); *Y10T 24/45602* (2015.01)

(58) Field of Classification Search
CPC .... A42B 3/08; A44B 11/263; Y10T 24/45602
See application file for complete search history.

(56) References Cited

U.S. PATENT DOCUMENTS 2,612,139 A * 9/1952 Collins ..... F16G 11/10 116/170
4,335,472 A 6/1982 Rappleyea
(Continued)

FOREIGN PATENT DOCUMENTS

DE 8714490 U1 9/1988
DE 296 08 345 U1 2/1997
(Continued)

OTHER PUBLICATIONS

European standard FprEN 12492:2011(D).
(Continued)

*Primary Examiner* — Robert J Sandy
(74) *Attorney, Agent, or Firm* — Fitch, Even, Tabin & Flannery, LLP

(57) ABSTRACT

A belt fastener for detachably connecting two belt ends has a housing and a plug, which can be clipped into the housing. The belt fastener can be a safety fastener opening if a predetermined tensile load acts on the belt ends. A separate finger flap is hinged to a front end of the plug for clipping it into the housing. The finger flap preloaded outwards in direction away from the plug by a separate spring. The finger flap can be brought in abutment with a stop surface of the housing by means of a stop surface opposite of the attachment point. Both stop surfaces are tilted forward by an angle of inclination (α) of >0°, particularly of 20°. In addition, two stop surfaces can be convexly or concavely curved.

8 Claims, 5 Drawing Sheets

(56) References Cited

U.S. PATENT DOCUMENTS

Figure 1:
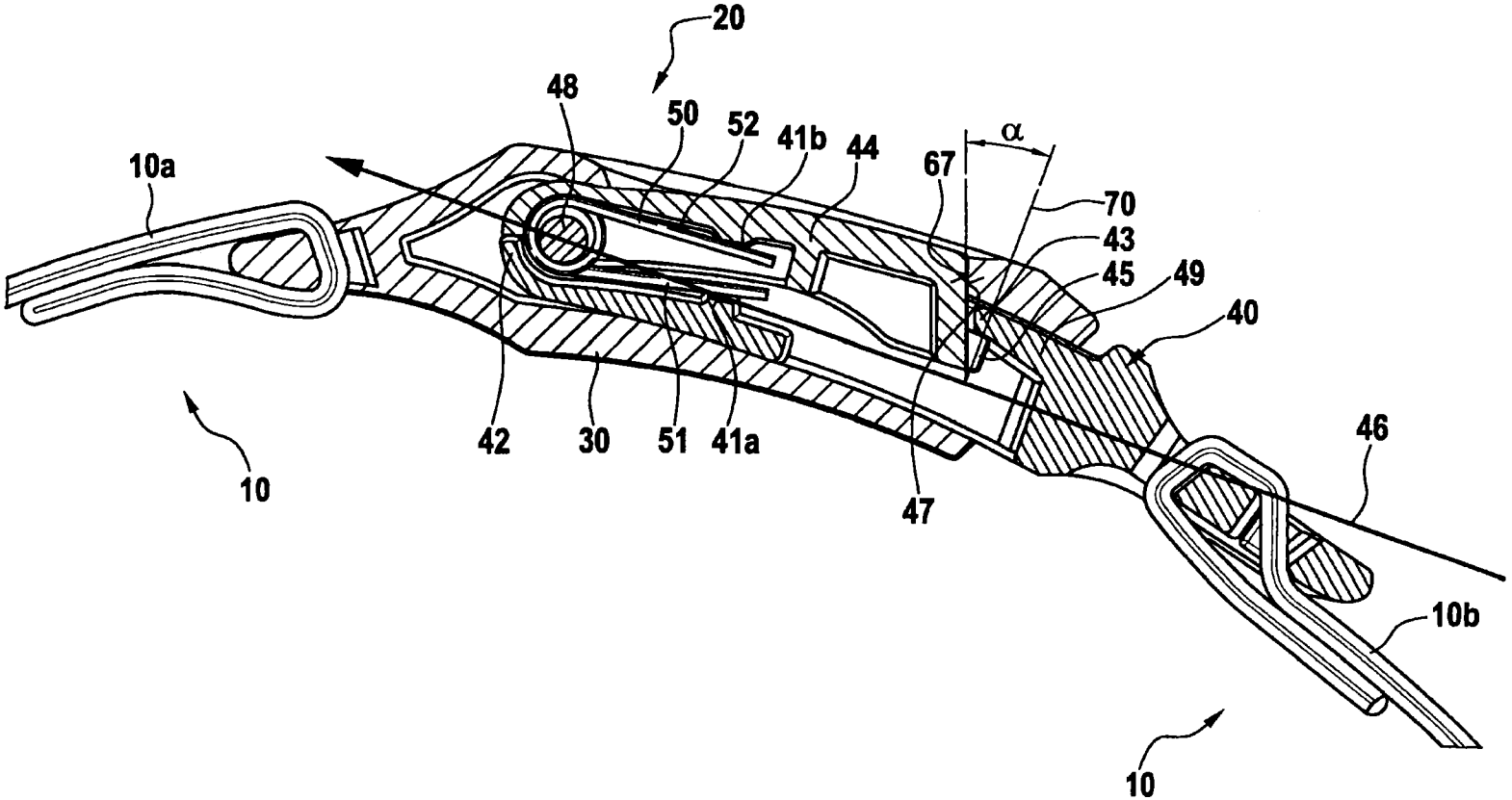

| | | | | |
|---|---|---|---|---|
| 5,322,037 | A * | 6/1994 | Tozawa | A44B 11/26 119/863 |
| 5,443,039 | A * | 8/1995 | Suchowski | A44B 11/2592 119/792 |
| 2004/0194264 | A1 | 10/2004 | Johansson | |

FOREIGN PATENT DOCUMENTS

| | | | |
|---|---|---|---|
| DE | 69306985 | T2 | 5/1997 |
| DE | 20 2007 017 686 | U1 | 3/2008 |
| EP | 0815761 | B1 | 2/2002 |
| GB | 2 263 721 | A | 8/1993 |
| WO | 2005/058086 | A1 | 6/2005 |
| WO | 2007/049048 | A1 | 5/2007 |

OTHER PUBLICATIONS

European standard FprEN 397, final draft on Jun. 2011.
International Search Report issued against International Application PCT/IB2012/002673.
International Preliminary Examination Report issued against International Application PCT/IB2012/002673.

* cited by examiner

BELT CLOSURE AND CHIN STRAP OF A PROTECTIVE HELMET EQUIPPED THEREWITH

CROSS REFERENCE TO RELATED APPLICATIONS

This application is a U.S. national phase application of International Application No. PCT/IB2012/002673, filed Oct. 30, 2012, which claims benefit of the priority date of German Application 10 2011 054 945.5, filed Oct. 31, 2011, which are hereby incorporated herein by reference in their entirety.

DESCRIPTION

The invention relates to a belt fastener for detachably connecting two belt ends comprising a housing connectable or connected to one of the belt ends, and a plug connectable or connected to the other belt end (10*b*) which plug can be clipped into the housing.

Further, the invention relates to a chin strap of a protective helmet equipped with such a belt fastener.

A fastener of this type and a chin strap equipped therewith are known from the document DE 20 2007 017 686 U1 which will be discussed below.

According to the European standard FprEN 397, final draft of June 2011, a chin strap is understood to be a strap extending below the chin and enhancing the support of a helmet. According to this standard, a chin strap attachment, i.e. a device for attaching the chin straps to helmet, comprises, for example, components attached to the ends of the chin strap for this purpose, and the part of the helmet shell or of the support means to which the chin strap is attached. Furthermore, according to this standard, the helmet shell or the support means has to be provided with a chin strap or equipped with devices for its attachment. Any chin strap delivered together with the helmet has to be attached to either the helmet shell or the support means.

The European standard FprEN 12492:2011(D) is based on the assumption that the chin strap bears the risk that the helmet may get caught and will, in the process, give rise to a risk of strangulation of the wearer of the helmet. The standard therefore requires that the chin strap or its attachment(s) or the support means in general has/have to fail so as to release the helmet held by the chin strap at a specific pulling force acting on the chin strap. In the safety test of protective helmets, therefore, also the chin strap is subjected to a prescribed test. For this purpose a chin strap frame which is a jaw simulation comprising two rigid cylindrical rolls having a specific diameter is mounted on a testing instrument. A known varying load is applied to the jaw simulation, and then the displacement of the jaw simulation is measured. The load is to be linearly increased at a speed of (500±50) N/min until the jaw simulation is released as a result of the failure of the support means. These values relate to the testing of mountaineers' helmets. In industrial safety helmets to which the former standard FprEN 397 relates the test jaw only has to be released at a force of at least 150 N and of a maximum of 250 N by the chin strap attachment(s) slackening. For the purposes of the test an industrial safety helmet is placed on a test head, and a pulling force is exerted on the chin strap. On the testing instrument which comprises the appropriate test head the test jaw is subjected to a pulling force of 150 N. This force is then increased by (20±2) N/min until the test jaw is released only due to the failure of the attachment(s).

According to the knowledge of the applicant chin strap testing is so far handled negligently in the industry. However, there is evidence that there will harsher inspections with regard to the compliance with the inspection standards relating to chin straps in the future, and that this issue will be given increased consideration by third party liability insurances in dealing with accidents in which a protective helmet is involved. In the applicable state of the art, particularly in patent literature, no examples could be found which would illustrate how chin strap attachments or support means of helmets should be formed so that they will slacken at a specific tensile load acting on the chin strap.

The document DE 296 08 345 U1 relates to a helmet particularly designed for industrial and fire safety and disaster management which also comprises a chin strap including a fastener. The same applies to the document DE 87 14 490 U1 which relates to a protective helmet comprising a chin strap adjustable in length and provided with a fastener including a lug and a mushroom head-shaped cone which can be brought in engagement with each other.

The abovementioned document DE 20 2007 017 686 U1 does not contain any indication of how, at a specific tensile load acting on the chin strap, its attachment or support means might slacken. The side straps of the chin strap can be connected to each other by means of a so-called quick-release catch which is widely used nowadays and known, e.g., from the document EP 0 815 761 B1 in its basic design. In a quick-release catch a latching surface area is evenly distributed around the top, bottom and outer side of two finger claps disposed on the opposing narrow sides of the fastener. With this even distribution an increased latching and support force of the fastener are to be achieved. All of this serves the purpose of preventing a release of the fastener while a high strain is exerted on it.

There are other types of safety equipment in which it is desired that the equipment will give way or disengage from the person wearing it to protect the person from injury or overstress. These include, for example, dog collars, school satchel or backpack straps, straps on brogues, straps on skiwear or skiing equipment and the like. In addition, fixing and releasing the chin strap is difficult with the chin strap according to the documents DE 20 2007 017 686 U1 or EP 0 810 761 B1 already mentioned several times above because the fastener of this known chin strap comprises finger claps which are located on the narrow side walls of the fastener and have to be operated by the wearer of the protective helmet by simultaneously applying pressure with two fingers so that the fastener can be opened at all with the plug latched. Further, it is disadvantageous that, in case of a bearded person applying the chin strap, the hair of the beard and/or the skin of the cheek may get caught when locking the fastener. Further, it is difficult to operate the known quick-release catch if the person fastening or releasing the chin strap wears gloves.

In addition, the time during which the finger claps function failure-free is limited in the known fastener because the finger claps are components integrally formed with the plug which have to apply the spring force required for clicking the plug into the finger openings at its narrow side walls at their point of attachment to the plug. The time span is simply limited by material fatigue and ageing. Above that, temperature variations may also affect the functionality of the finger claps of the known fastener.

Finally, if a transverse pull acts on the chin strap, a situation may arise in which the fastener cannot be opened at all by means of finger pressure because the transverse pull may result in a finger flap being blocked so that it cannot be depressed by pressure applied with the fingers.

The characteristics of the known fastener described above result in this fastener being unsuitable for contributing to the reduction of the risk of strangulation of the wearer of the helmet required by the standard. Therefore, its attachment(s) or, generally, the support means actually have to fail when using the known chin strap so that the helmet held in place by the chin strap is released in case of a risk of strangulation. However, as explained above, the state of the art does not provide for any remedy for an intentional failure.

Further, it is critical that in the known chin straps the failure of the attachment(s) or, generally, the support means, may take place prematurely, i.e. already when there is not even any risk of strangulation. In case of a fall this may involve the drawback that the person wearing the helmet loses it prematurely and hits some obstacle with the head if the helmet is no longer on the head. Therefore, it has to be ensured that the release of the helmet within the tolerance range for preventing a risk of strangulation will not take place prematurely. Here as well the state of the art does not offer any remedy.

Above that, it would be required to be able to select the threshold value for the load at which a failure is to take place, e.g. depending on the sex, weight or age of the person for whom the protective helmet or any other type of safety equipment is intended. The invention is intended to cater for remedy here.

Therefore, it is the object of the invention to overcome the problems described above and to ensure that the support or attachment means of a helmet or, generally, a strap gear, becomes unfastened at a defined tensile load acting on the chin strap or the belt ends or releases the person wearing it in a simple manner.

According to the invention this object is solved on the basis of a fastener of the type described in the introduction by designing the fastener as a safety fastener opening if a specific tensile load acts on the belt ends or on the housing and the plug.

The solution according to the invention, to design the fastener as a safety fastener opening at a specific tensile load, ensures that the support means of a protective helmet will fail so as to release the helmet or to unfasten a belt or strap gear of any kind from its wearer in a simple and safe manner.

Advantageous embodiments of the invention constitute the subject matter of the dependent claims.

In one embodiment of the belt fastener according to the invention the plug to be clipped into the housing comprises a separate finger flap disposed at one of its wide sides which is hinged to a bolt at a front end of the plug. The finger flap which substantially occupies the entire wide side offers a wide surface for an operation with the fingers and may, in this way, be operated with one finger without problems, even while wearing a glove. The opposing wide side of the housing of the fastener will usually be facing the wearer of the strap fitting when the fastener is in the closed position so that it constitutes a support for the fastener and renders its one-finger operation possible and, at the same time, eliminates the risk of skin and/or the hair of a beard getting caught.

In a further embodiment of the belt fastener according to the invention the finger flap is preloaded in direction of a position in which it protrudes beyond the plug towards the outside by a separate spring. The separate spring is, in other words, a spring manufactured separately from the plug which may, with regard to the material, the construction, and the spring force, be designed independent of the material and the design of the plug and therefore permits the independent choice of the magnitude of a specific preload. That again permits the selection of a specific value of the pulling force for opening the safety fastener.

In another embodiment of the belt fastener according to the invention the position in which the finger flap protrudes beyond the plug towards the outside is defined by a protrusion on the finger flap which can be brought in abutment with a protrusion on a body of the plug. In this embodiment of the invention a specific initial position the finger flap may be defined so that the opening of the fastener starts as soon as the finger flap begins to leave this initial position, and this in a reproducible way.

In another embodiment of the belt fastener according to the invention the spring is a one or more leg spring surrounding the bolt and supported by on the finger flap and the body of the plug at its free ends. Such a one or more leg spring has a particularly suitable design since the levers by means of which its legs act on the finger flap and the body of the plug have a sizable length while requiring minimum space. This renders the generation of a large force possible which could not be readily attained with another spring, e.g. a helical compression spring mounted transversely with respect to the insertion direction of the plug between the finger flap and the body of the plug. By varying the spring parameters a specific pulling force at which the belt fastener according to the invention is to open may be defined in a simple manner.

However, it should be noted that any other spring, for example simply a V-shaped laminated spring made of spring steel, could be used instead of a leg spring. Steel springs have the general advantage that they, in contrast to springs made of plastics or the like, are less inclined to change their spring force at varying temperatures.

In another embodiment of the belt fastener according to the invention the finger flap has a stop surface at its end opposing its attachment point which abuts to a stop surface formed in a finger opening in a wide side of the housing is when the plug is inserted in the housing. The mutual contact of these two stop surfaces retains the belt fastener in the closed position. The finger opening formed in of a wide side of the housing matches the large-area design of the finger flap rendering the operation of the fastener by applying pressure with one finger possible.

In another embodiment of the belt fastener according to the invention the two stop surfaces are tilted forward by an angle not equivalent to 0° relative a perpendicular to the insertion direction of the plug.

The angle of inclination of the stop surfaces renders the selection of a specific tensile load of the belt ends or of the housing and plug possible at which the fastener is to open. The angle of inclination of the stop surfaces may be simply selected so that the finger flap is pivoted into the plug towards the inside in the finger opening of the housing when a specific magnitude of the tensile load is reached, the stop surface of the finger flap finally leaving the stop surface in the finger opening so that the plug can be pulled out of the housing.

In another embodiment of the belt fastener according to the invention the angle of inclination is 20°. Actually, a suitable value for the angle of inclination is in a range from a value of less than 20° to a value of more than 20°. The value of 20° was established by experiments. The experiments also showed that an angle of inclination of 10° may also be suitable, however, that it requires a very high tensile load at which the fastener actually opens. The variation of the angle of inclination permits fine tuning for attaining pulling force value required by the standard at which the support or attachment means of the chin strap of a protective helmet or, generally, a strap fixture, is to fail. This fine tuning renders the consideration of the friction effective between the stop surfaces in the attainment of a desired pulling force value possible, even if the fact that the friction may also be changed by humidity if a chin strap or strap gear in general gets in contact with rain water or simply with sweat is taken into account.

In another embodiment of the belt fastener according to the invention the two stop surfaces are convexly or concavely curved in the top view, i.e. when regarding the finger flap and the housing from above, respectively, namely so that the stop surface of the finger flap has a radius of curvature which is smaller than the radius of curvature of the stop surface of the finger opening. The result is a line contact between the two stop surfaces which is usually located in the centre, however, moves towards the outside in the one or other direction depending on pulling direction when a transverse pull acts on the belt ends. The reduction of the mutual contact of the stop surfaces to a line contact significantly reduces the effect of the friction. Furthermore, the line contact permits the selection of the maximum possible spring force so that the effect of the friction is additionally reduced accordingly in relation to the spring force. If the two stop surfaces were curved so as to be complementary with respect to each other a substantially higher friction would result. According to the state of the art described in the introduction this is aimed at because the known quick-release catch is to be increasingly secured against opening when the load increases. According to the state of the art, therefore, also the inclination of the contacting stop surfaces of the finger flap and the housing is not designed so as to be inclined obliquely forwards relative to the insertion direction but obliquely backwards relative to the insertion direction.

Figure 2:
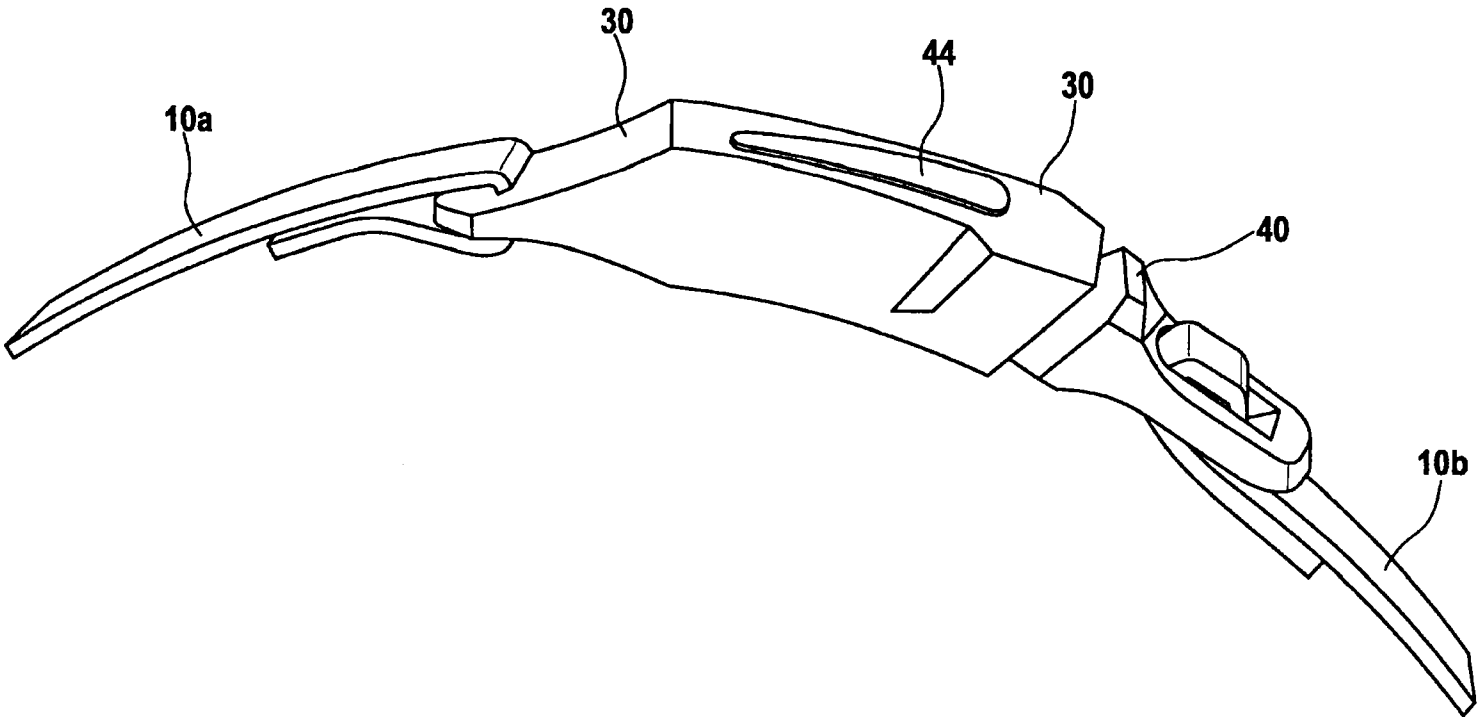
Figure 3:
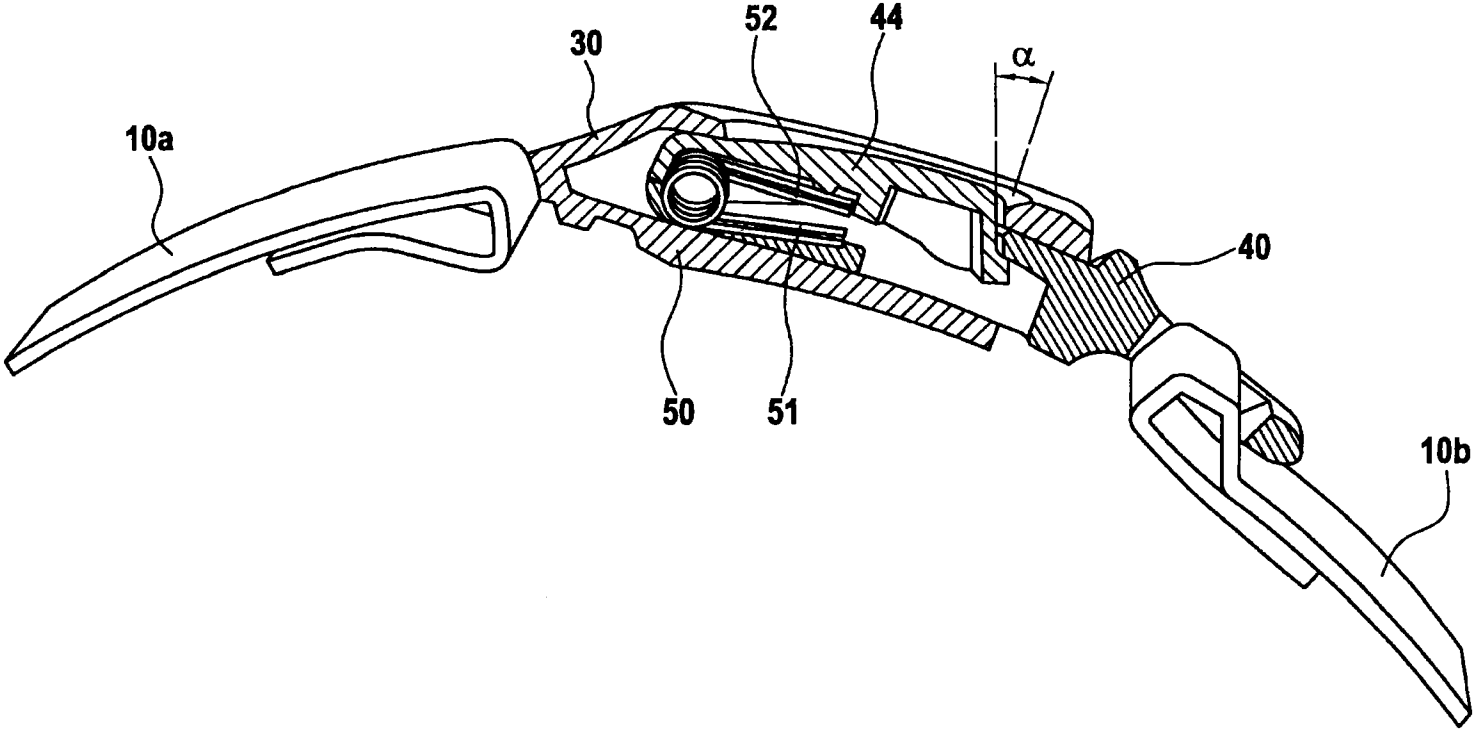
Figure 4:
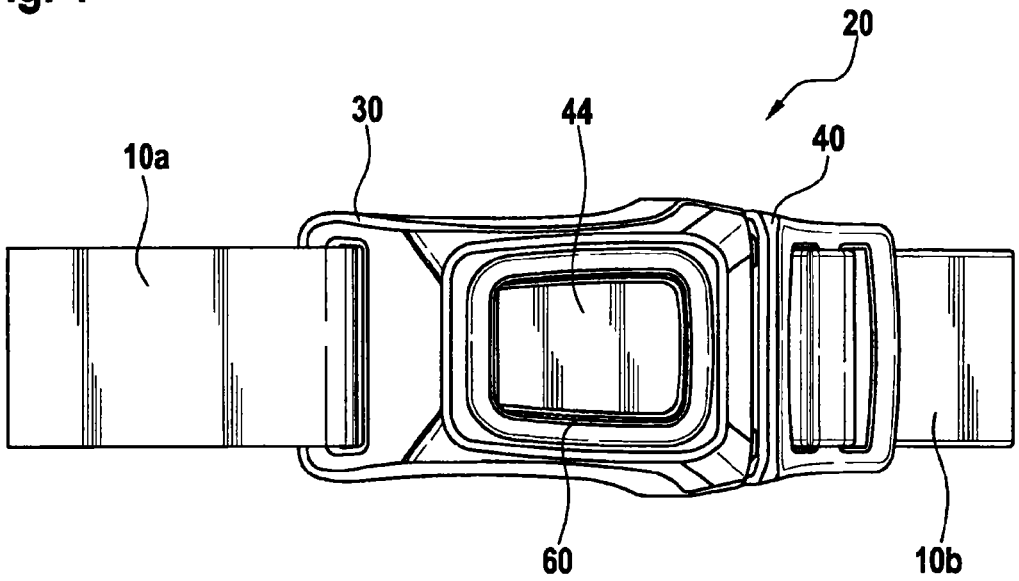
Figure 5:
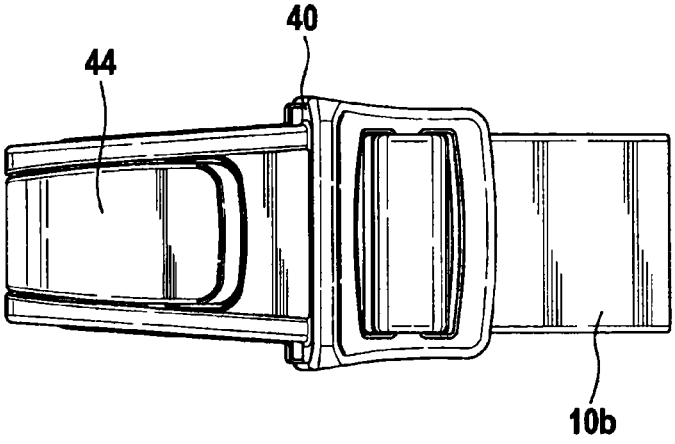
Figure 6:
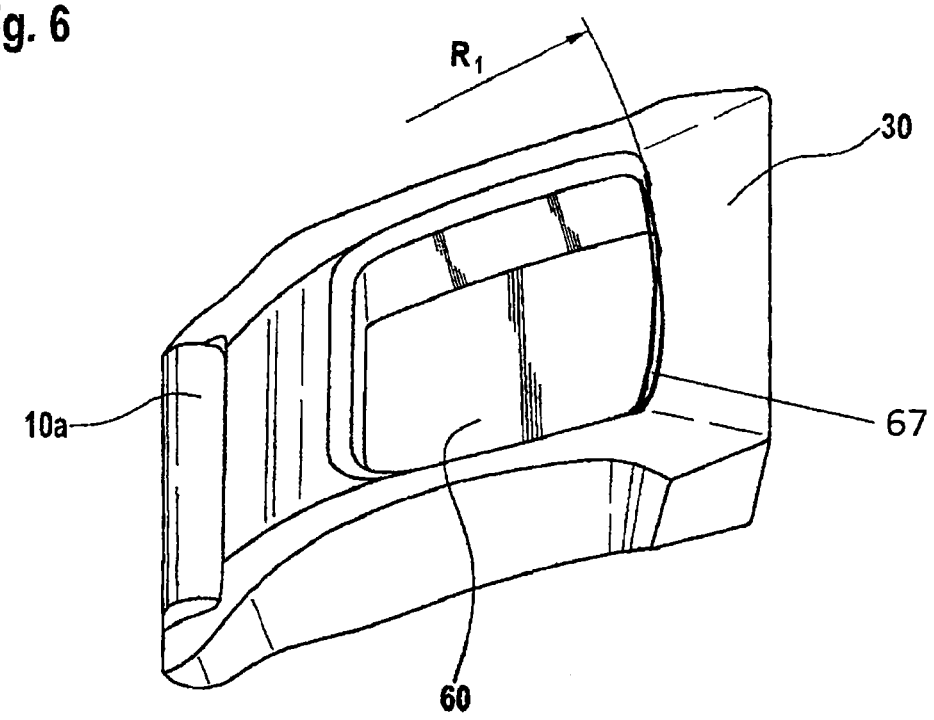
Figure 7:
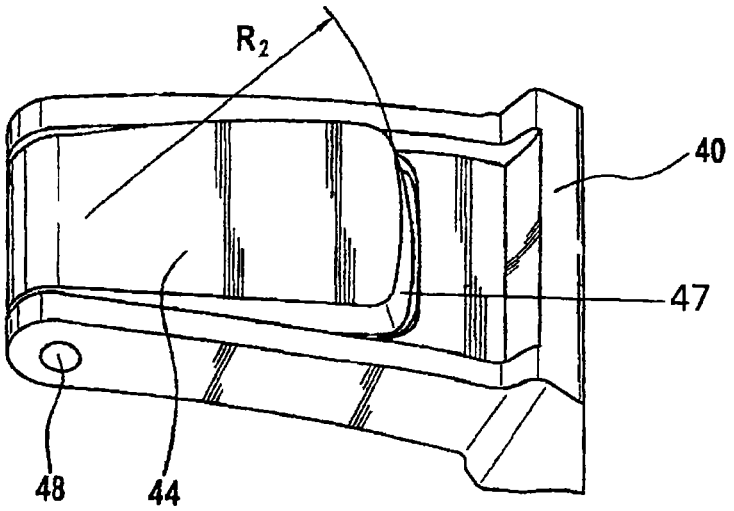

In the following, embodiments of the invention will be described in more detail with reference to the drawings in which:

FIG. 1 shows a longitudinal sectional view of a preferred embodiment of a belt fastener according to the invention connecting two belt straps with each other and illustrated in a closed state, FIG. 2 shows the belt fastener according to FIG. 1 in a slightly perspective side view, FIG. 3 shows the belt fastener according to FIG. 2 in an approximately identical perspective view, however, in addition in a longitudinal section, FIG. 4 shows the belt fastener according to FIG. 1 approximately in a top view, FIG. 5 shows a top view of the plug of the belt fastener according to FIG. 1 as a detail, FIG. 6 shows a perspective view of the housing of the belt fastener according to FIG. 1 as a detail, and FIG. 7 shows a perspective view of the plug of the belt fastener according to FIG. 1 as a detail.

FIGS. 1 to 7 show a belt fastener altogether designated by 20 and comprising two ends 10*a*, 10*b* of a strap or belt 10 attached to it. The strap 10 may be formed as a part of a support means of a protective helmet none of which is shown. The belt fastener 20 comprises a housing 30 and a plug 40 insertable into the housing 30. In FIG. 1 which shows a longitudinal sectional view of the strap 10 including the belt fastener 20 the plug 40 is inserted into the housing 30 and engaged or latched there in the manner described in more detail below. FIG. 2 shows the strap 10 and the belt fastener 20 according to FIG. 1 in a slightly perspective side view. FIG. 4 shows the strap 10 and the belt fastener 20 according to FIG. 1 approximately in a top view. On the other hand the plug 40 of the belt fastener 20 according to FIG. 1 shown in a top view in FIG. 5 and the housing 30 of the belt fastener 20 according to FIG. 1 shown in a perspective view in FIG. 6 are respectively shown in detail. FIG. 3 shows a view as shown in FIG. 2, however, in addition also in a longitudinal section. FIG. 7 shows a perspective view of the plug 40 according to FIG. 1 as a detail.

According to the illustration in FIGS. 1 and 5 the plug 40 comprises a finger flap 44 disposed on one of its wide sides (in FIG. 5, it is the wide side facing the observer). The finger flap 44 is hinged to a bolt 48 at a front end 42 of the plug 40 as can be seen in FIGS. 1, 3 and 7. The bolt 48 is non-rotatably supported in two bearing blocks integrally formed with a body 49 of the plug 40 which, however, are not illustrated in the drawings. To this end the bolt 48 may simply have a force fit in the bearing blocks. The finger flap 44 is a separate component, i.e. a component separate from the plug 40 which is separately produced and then pivotably connected to the body 49 of the plug 40 with the aid of the bolt 48. An insertion direction, i.e. the direction in which the plug 40 is inserted into the housing 30, is indicated by an arrow 46 in FIG. 1. In FIG. 1 the plug 40 is inserted into the housing 30 from the right to the left so that the front end 42 of the plug 40 is the end shown on the left side in FIG. 1. The interior of the housing 30 matches the outer shape of the plug 40 so that the inserted plug 40 has no noteworthy clearance in the housing.

Around the bolt 48 a spring 50 is mounted which is a leg spring formed so that das the free ends of its legs 51, 52 strive to move away from each other in the embodiment of the belt fastener 20 described here and shown in the drawings. The spring 50 surrounds the bolt 48 and is supported on the finger flap 44 and on the body 49 of the plug 40 on protrusions 41 a and 41 b at the free ends of its legs 51, 52 as can be best seen in FIG. 1. In this way the finger flap 44 is preloaded by the spring 50 in direction of a position in which the finger flap 44 protrudes towards the outside beyond the plug 40, to put it more precisely, beyond the body 49 of the plug 40. This position the finger flap 44 is shown in FIGS. 1, 3 and 7. In the slightly perspective longitudinal sectional view shown in FIG. 3 it can be seen that the spring 50 is a two-legged spring. A two-legged spring develops more force than a one-legged spring. The position in which the finger flap 44 protrudes towards the outside beyond the plug 40 or its body 49 is, according to the illustration in FIG. 1, defined by a protrusion 45 on the finger flap 44 abutting on a protrusion 43 on the body 49 of the plug 40. Owing to the mutual contact of the protrusions 43 and 45 the pivoting of the leg spring 50 about the bolt 48 is limited counterclockwise. By selecting the material of the spring 50 and the number of the legs the force applied to the protrusion 43 by the spring of the finger flap 44 can be selected.

Any spring providing the tension required for the opening force may be selected as the spring 50. Instead of a leg spring it could therefore be a compression spring, a laminated spring, resilient plastic elements, laminated carbon springs, coil springs made of carbon or any other type of spring. In the embodiment described here the two-legged spring is made of high alloy steel and therefore its characteristics will not substantially change in a temperature range of −30 to +40° C. Both the finger flap 44 and the plug 40 were manufactured as separate die cast components. Both were then assembled with the aid of the bolt 48 while incorporating the spring 50. This design of the spring 50 provides for more constant characteristics across the abovementioned temperature range than a plastic spring integrally formed with a plastic plug and only connected to it by a plastic bridge as in the state of the art described in the introduction. Even though, instead of a leg spring, a compression spring could be disposed transverse to the insertion direction 46 between the body 49 of the plug 40 and the finger flap 44, the spring 50 used in the embodiment shown acts on the finger flap via a long lever arm which provides for an increase of force.

The finger flap 44 has a stop surface 47 at its end opposing its attachment point on the bolt 48 which abuts on a stop surface 67 in a finger opening 60 formed in a wide side of the housing 30 when the plug 40 is inserted in the housing 30 as shown in FIG. 1. The finger opening 60 can be best seen in FIG. 6 in which the housing 30 is shown in detail in a perspective view. The two stop surfaces 47, 67 are formed so that they are obliquely tilted forward relative to the insertion direction 46 of the plug 40. In the shown embodiment the two stop surfaces 47, 67 together with a perpendicular 70 located in the longitudinal sectional plane of the fastener 20 on an arrow line located in the same plane which symbolizes the insertion direction 46 of the plug 40 respectively form an angle of inclination a of approximately 20°. The angle of inclination a is selected depending on the desired force. The larger the angle a is made the smaller the pulling force will become which has to be exerted on the belt ends 10*a*, 10*b* to automatically open the belt fastener 20.

If, on the other hand, the belt fastener 20 is to be opened manually a finger is pressed onto the finger flap 44 through the finger opening 60, and the former is thereby pressed into the plug 40 from the position shown in FIG. 1 against the force of the spring 50, and the belt fastener is opened manually in this way.

In the cross section, i.e. substantially transverse to the insertion direction 46, the housing 30 and the plug 40 substantially have the form of a flat rectangle, respectively, and are formed so that the finger opening 60 and the finger flap 44 respectively extend in one of the side walls of their allocated rectangles. In other words, the finger flap 44 is disposed in one of the wide sides of the body 49 of the plug 40, and the finger opening 60 is disposed in one of the wide sides of the housing 30 as can be readily seen in FIGS. 5 and 6.

According to FIG. 1, the two stop surfaces 47, 67 are convexly or concavely curved in the top view, i.e. as regarded from the top. The stop surface 47 of the finger flap 44 has a radius of curvature $R_2$ which is smaller than a radius of curvature $R_1$ of the stop surface 67 of the finger opening 60. The radiuses of curvature $R_1$ and $R_2$ are indicated in FIG. 6 or 7. Owing to this design the stop surfaces 47, 67 are not in a mutual surface contact but in a mutual line contact when they abut as shown in FIGS. 1 and 2 to 4. If the tensile load is applied to the belt ends 10*a*, 10*b* in a line with the insertion direction 46 the contact line is located in a transverse central plane of the finger flap 44 and of the housings 30 in which also the insertion direction 46 and the perpendicular 70 are located. If the tensile load is applied obliquely with regard to the insertion direction 46 the contact line will move upwards or downwards in FIG. 4 depending on the pull direction.

Since the belt fastener 20 is designed as a safety fastener which is to open at a specific tensile load acting on the strap 10 the angle a is selected so that, at a specific tensile load acting on the strap 10, the force by which the stop surfaces 47, 67 are pressed against each other will ultimately become so large that the finger flap 44 is moved into the plug 40 owing to the force component which will then act on the finger flap 44 orthogonally with respect to the insertion direction 46 and strive to move the finger flap 44 into the plug 40. As soon as the stop surfaces 47 and 67 have gotten clear of each other, i.e. the finger flap 44 has sufficiently moved into the plug 40 at its, according to FIG. 1, right end in the finger opening 60, the plug 40 is pulled out of the housing 30 owing to the tensile load still acting on the strap 10. The belt fastener 20 thus automatically opens at a specific tensile load acting on the strap 10 which is why it is referred to as a safety fastener here.

The chin strap of a protective helmet (both not shown) may be equipped with the belt fastener according to the invention. In this case the attachment points of the chin strap on the inside of the helmet or on the support means of the same do not have to be modified so that the helmet is released at a specific tensile load acting on the chin strap since this release is effected only by opening the belt fastener according to the invention.

The invention claimed is:

1. A belt fastener for detachably connecting two belt ends, comprising:

a housing connectable or connected to one of the belt ends, and a plug which can be clipped into the housing and is connectable or connected to the other belt end, wherein the fastener is formed as a safety fastener which opens if a specific tensile load acts on the belt ends or on the housing and the plug, and wherein the plug to be clipped into the housing comprises a separate finger flap which is located on one of its wide sides and hinged to a bolt at a front end of the plug.

2. The belt fastener according to claim 1, wherein the finger flap is preloaded by a separate spring in the direction of a position in which the finger flap protrudes towards the outside beyond the plug.

3. The belt fastener according to claim 2, wherein the position in which the finger flap protrudes towards the outside beyond the plug is defined by a protrusion on the finger flap which can be brought in abutment on a protrusion on a body of the plug.

4. The belt fastener according to claim 1, wherein a spring is a one or more leg spring surrounding the bolt and supported on the finger flap and on the body of the plug at its free ends.

5. The belt fastener according to claim 1, wherein the finger flap comprises a stop surface at its end opposing its attachment point, which stop surface abuts to a stop surface in a finger opening formed in of a wide side of the housing when the plug is inserted in the housing.

6. The belt fastener according to claim 5, wherein the two stop surfaces are tilted forward by an angle ($\alpha$) not equal to 0° with respect to a perpendicular to the insertion direction of the plug.

7. The belt fastener according to claim 6, wherein the angle of inclination ($\alpha$) is 20°.

8. The belt fastener according to claim 5, wherein the two stop surfaces are convex or concave and curved so that the stop surface of the finger flap has a radius of curvature ($R_2$) which is smaller than the radius of curvature ($R_1$) of the stop surface of the finger opening.

* * * * *